US007695080B2

(12) United States Patent
Chen et al.

(10) Patent No.: US 7,695,080 B2
(45) Date of Patent: Apr. 13, 2010

(54) SECURING DEVICE FOR A DRAWER SLIDE

(75) Inventors: Ken-Ching Chen, Kaohsiung Hsien (TW); Hsiu-Chiang Liang, Kaohsiung Hsien (TW); Chun-Chiang Wang, Kaohsiung Hsien (TW)

(73) Assignee: King Slide Works Co., Ltd., Kaohsiung Hsien (TW)

( * ) Notice: Subject to any disclaimer, the term of this patent is extended or adjusted under 35 U.S.C. 154(b) by 233 days.

(21) Appl. No.: 11/806,856

(22) Filed: Jun. 5, 2007

(65) Prior Publication Data

US 2008/0303397 A1 Dec. 11, 2008

(51) Int. Cl.
*A47B 88/04* (2006.01)

(52) U.S. Cl. ..... 312/333; 312/334.4; 312/334.14

(58) Field of Classification Search ..... 312/330.1, 312/333, 334.1, 334.4, 334.6, 34.7, 334.8, 312/334.14, 334.44, 334.46, 319.1; 384/20, 384/21, 22; 211/26

See application file for complete search history.

(56) References Cited

U.S. PATENT DOCUMENTS

| | | | | | |
|---|---|---|---|---|---|
| 3,918,752 | A * | 11/1975 | Leone et al. | ..... | 292/174 |
| 4,139,249 | A * | 2/1979 | Hillman | ..... | 312/333 |
| 4,291,929 | A * | 9/1981 | Faust | ..... | 312/334.4 |
| 5,261,737 | A | 11/1993 | Faust et al. | | |
| 5,292,198 | A * | 3/1994 | Rock et al. | ..... | 384/21 |
| 5,439,283 | A | 8/1995 | Schroder et al. | | |
| 5,580,139 | A | 12/1996 | Grabher | | |
| 5,632,541 | A | 5/1997 | Uthoff | | |
| 6,155,661 | A * | 12/2000 | O'Neil et al. | ..... | 312/334.44 |
| 6,230,903 | B1 * | 5/2001 | Abbott | ..... | 211/26 |
| 6,454,371 | B1 | 9/2002 | Muterthies et al. | | |
| 6,913,334 | B2 | 7/2005 | Weichelt | | |
| 6,945,618 | B2 | 9/2005 | Kim et al. | | |
| 2001/0019235 | A1 * | 9/2001 | Hammerle | ..... | 312/334.4 |
| 2004/0095047 | A1 | 5/2004 | Salice | | |
| 2004/0227440 | A1 | 11/2004 | Booker et al. | | |
| 2005/0231083 | A1 | 10/2005 | Garcie | | |
| 2006/0082267 | A1 * | 4/2006 | Lin | ..... | 312/333 |

FOREIGN PATENT DOCUMENTS

| | | |
|---|---|---|
| TW | 1249389 | 2/2006 |

* cited by examiner

*Primary Examiner*—James O Hansen
(74) *Attorney, Agent, or Firm*—Rosenberg, Klein & Lee

(57) ABSTRACT

A securing device for a drawer slide includes a base, a pressing element and a first elastic element. The pressing element is slidably connected to the base. The pressing member has a releasing block. The first elastic element is disposed in the pressing element. When the pressing element is pressed, the releasing block is partially inserted into the base. When the pressing force against the releasing block is released, the pressing element restores its original state. The base is provided with a fixing plate for mounting the base to a drawer. A holding element is provided in a drawer slide to facilitate engagement of the base. By pressing the pressing element, the engagement of the holding element is released.

1 Claim, 13 Drawing Sheets

SECURING DEVICE FOR A DRAWER SLIDE

BACKGROUND OF THE INVENTION

1. Field of the Invention

This invention relates to a securing device for a drawer slide, and more particularly to a securing device to quick assemble and disassemble a slide and a drawer.

2. Description of the Prior Art

A conventional installation of an undermount drawer slide uses screws as fasteners for securing purpose. A quick assembly and disassembly device was derived later on.

These designs have been disclosed by many patent publications, such as, Taiwanese Patent Publication No. I249389 and U.S. Pat. Nos. 5,261,737; 5,439,283; 5,580,139; 5,632,541; 6,454,371; 6,913,334; 6,945,618; 2004/0095047; 2004/0227440 and 2005/0231083, etc., with regards to the quick assembly and disassembly devices, some of which have further disclosed a micro adjustment of moving up and down position of the slide.

Most of them are formed integrally in plastic material, and comprise handles and tenons. The resilient character of the material facilitates the tenon to be held in the slide, while the handle is adapted to release the locking status.

Such designs have a larger size, and the material will loose its resilient character after a period of time and loose its holding capability.

SUMMARY OF THE INVENTION

In view of the above shortcomings, this invention provides a securing device for a drawer slide which comprises a base, a pressing element and a first elastic element, said base comprising a fixing plate connected with a connecting element, said connecting element having a through hole; the pressing element slidably connected to said connecting element of said base, said pressing element comprising a releasing block corresponding in position to said through hole of said connecting element; and the first elastic element accommodated between said connecting element and said pressing element.

Preferably, the securing device further comprises a slide having a horizontal through hole and a holding element at one end thereof, said holding element having an engaging end and a connecting end, said engaging end being inserted through said horizontal through hole and extending outwardly from said slide, said connecting end being disposed in said slide and connected with a second elastic element.

Preferably, said second elastic element is a spring.

Preferably, said second elastic element is a leaf spring.

Preferably, said slide comprises a sleeve at the end of said slide, said sleeve being connected with a knob and a protruding sleeve, said slide having a vertical through hole, said protruding sleeve being inserted through said vertical through hole and controlled by sad knob.

Preferably, said sleeve comprises a first case and a second case, said protruding sleeve has inner threads, and said knob comprises a threaded rod and a circular groove, said first case comprising a first recess and a first neck section, said second case comprising a second recess and a second neck section, said first recess and said second recess accommodating said protruding sleeve, said threaded rod of said knob being connected to said inner threads of sad protruding sleeve, notches being provided on said protruding sleeve, protruding ribs being provided in said first and second recesses in relation to said notches of said protruding sleeve, said circular groove of said knob engaging with said first neck section and said second neck section.

Preferably, said first case and said second case have a first hole and a second hole in relation to said horizontal through hole of said slide for accommodation of said holding element, said engaging end of said holding element being inserted through said horizontal through hole of said slide and extending outwardly from said slide.

Preferably, said slide comprises a sleeve and a knob at the end of said slide, said sleeve having a threaded hole, and said knob comprising a threaded rod, said slide having a vertical through hole, said sleeve being disposed in said slide, said threaded rod of said knob being connected to said threaded hole of said sleeve and extending through said vertical through hole of said slide.

It is the primary object of the present invention to provide a securing device for a drawer slide, which has a compact size.

It is another object of the present invention to provide a securing device for a drawer slide, which is easy to operate and has a longer lifespan.

DETAILED DESCRIPTION OF THE PREFERRED EMBODIMENTS

Figure 1:
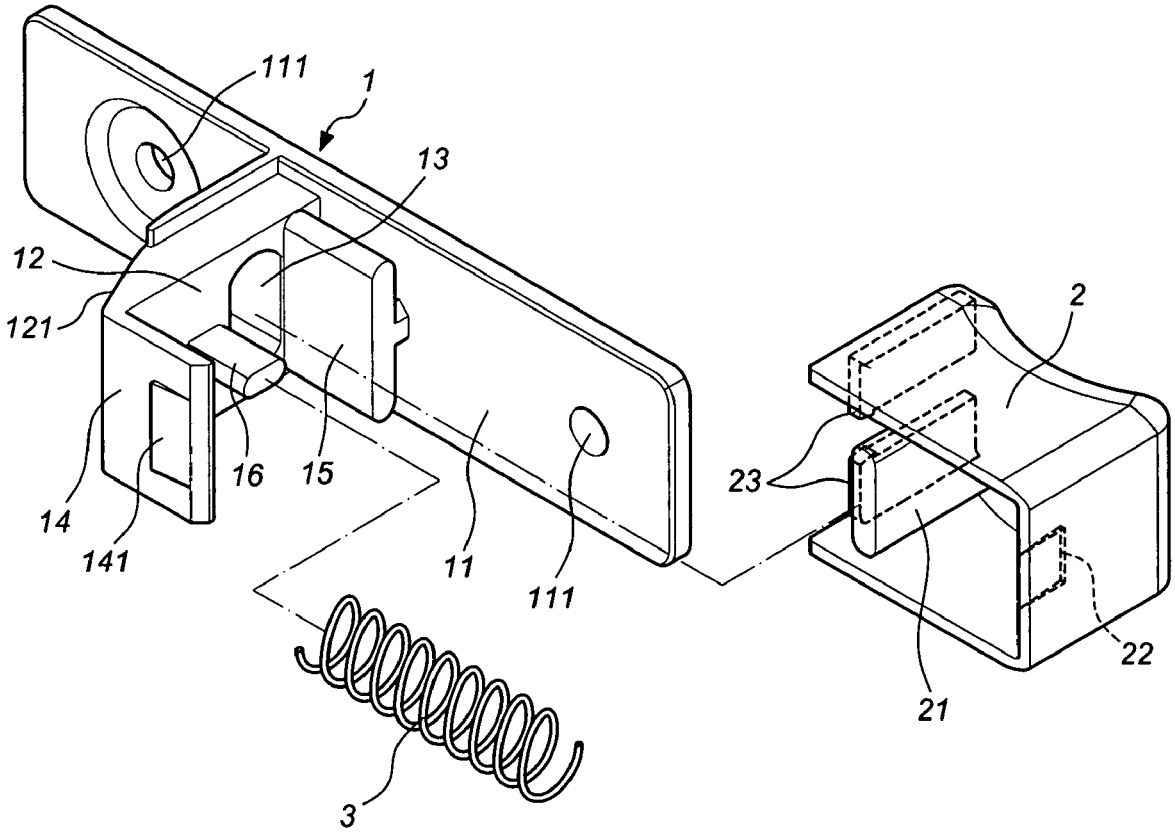
FIG. 1 is an exploded view showing a base, a pressing element, and a first elastic element of a first embodiment of the present invention.
Figure 2:
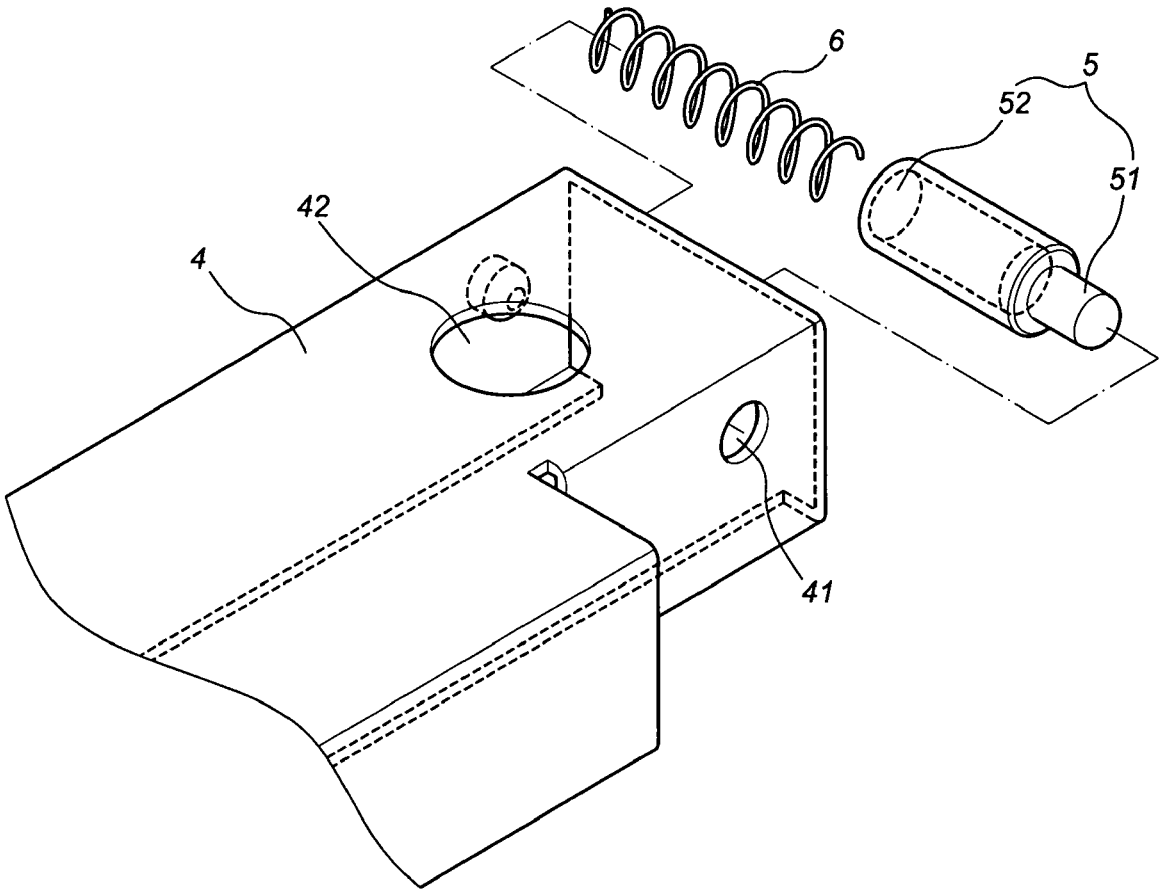
FIG. 2 is an exploded view showing a slide, a holding element, and a second elastic element of the first embodiment of the present invention.

As shown in FIGS. 1 and 2, a first embodiment of the present invention comprises a base 1, a pressing element 2, a first elastic element 3, a slide 4, a holding element 5, and a second elastic element 6.

The base 1 comprises a fixing plate 11 and a connecting element 12 vertically extending from the fixing plate 11. The fixing plate 11 has apertures 111. The connecting element 12 comprises a through hole 13, a first fixing piece 14, a second fixing piece 15 and a fixing post 16. The first fixing piece 14 has a protrusion 141. The connecting element 12 has a slanting surface 121 next to the first fixing piece 14.

The pressing element 2 is slidably connected to the connecting element 12 of the base 1, and comprises a releasing block 21 corresponding in position to the through hole 13 of the connecting element 12. A protruding buckle 22 is provided on an inner closed side of the pressing element 2, and a pair of insertion plates 23 is provided on the opposite side which is an open side. The protruding buckle 22 of the pressing element 2 is engaged with the protrusion 141 of the first fixing piece 14 of the base 1 with the insertion plates 23 engaging with the second fixing piece 15.

The first elastic element 3 is located between the connecting element 12 of the base 1 and the pressing element 2. One end of the first elastic element 3 is inserted onto the fixing post 16 of the connecting element 12.

The slide 4 has a horizontal through hole 41 and a vertical through hole 42 at one end thereof.

Figure 3:
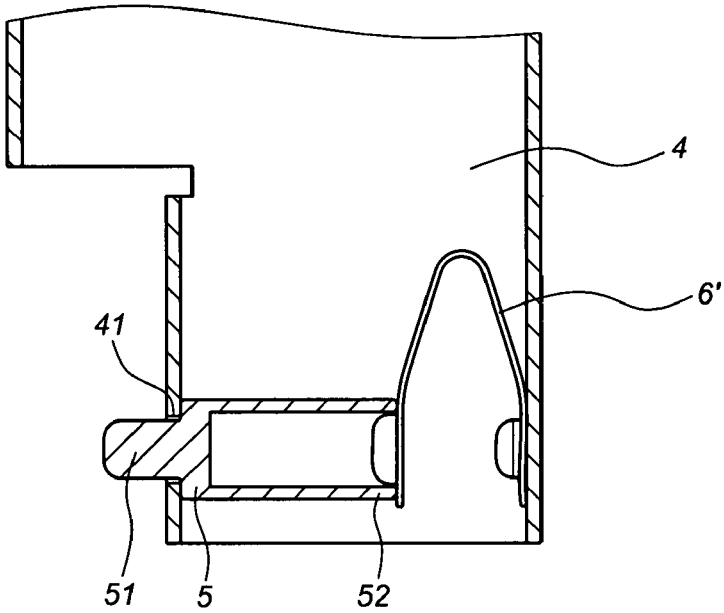
FIG. 3 is a side cross-sectional view showing a leaf spring of the first embodiment of the present invention.

The holding element 5 has an engaging end 51 and a connecting end 52. The holding element 5 is secured to the through hole 41 of the slide 4. The engaging end 51 of the holding element 5 is inserted through the through hole 41 and extends outwardly from the slide 4. The connecting end 52 of the holding element 5 is connected with the second elastic element 6 and disposed in the slide 4. The second elastic element 6 can be a spring, as shown in FIG. 2, or a leaf spring 6', as shown in FIG. 3.

Figure 4:
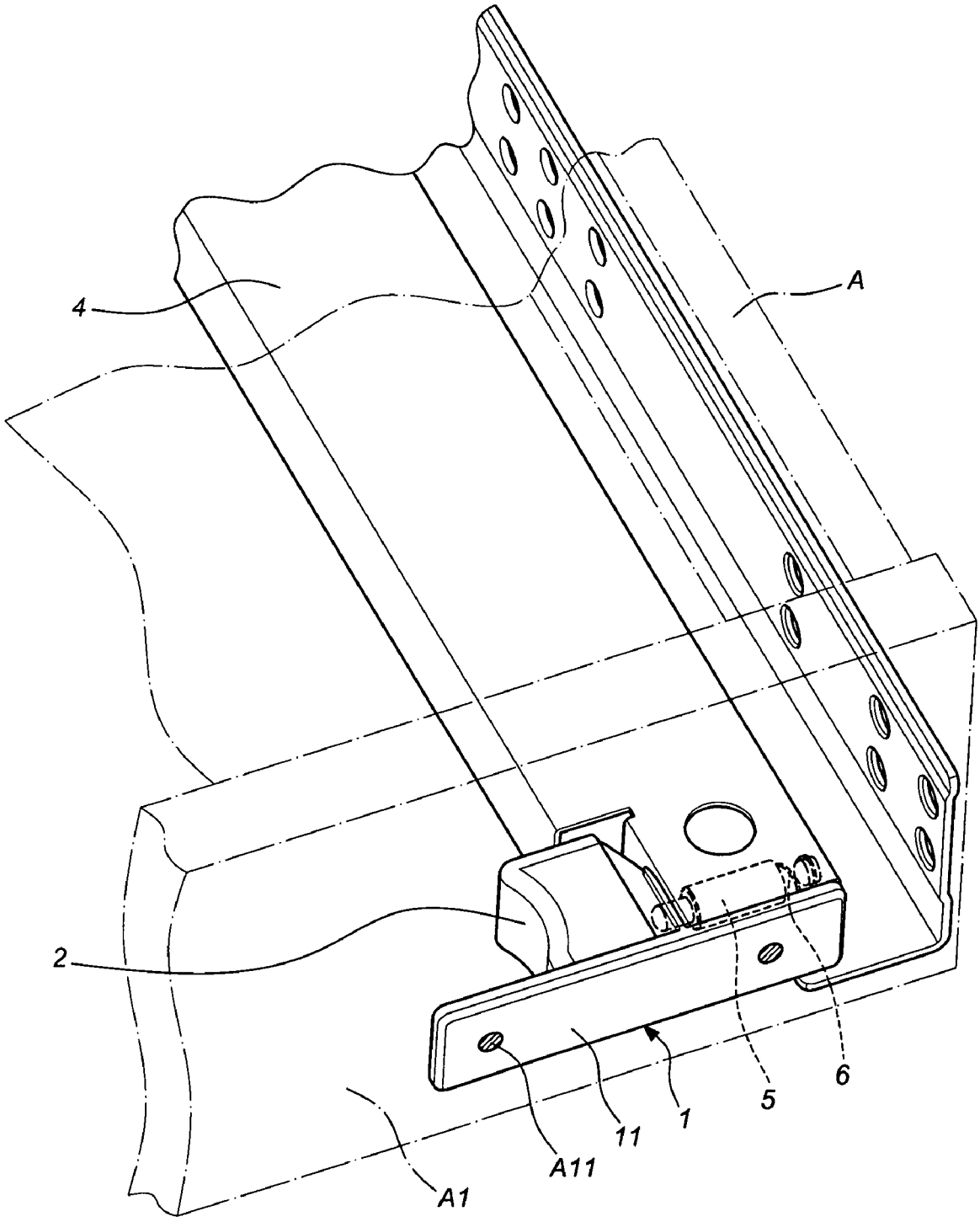
FIG. 4 is a perspective view of the first embodiment of the present invention incorporated with a drawer.
Figure 5:
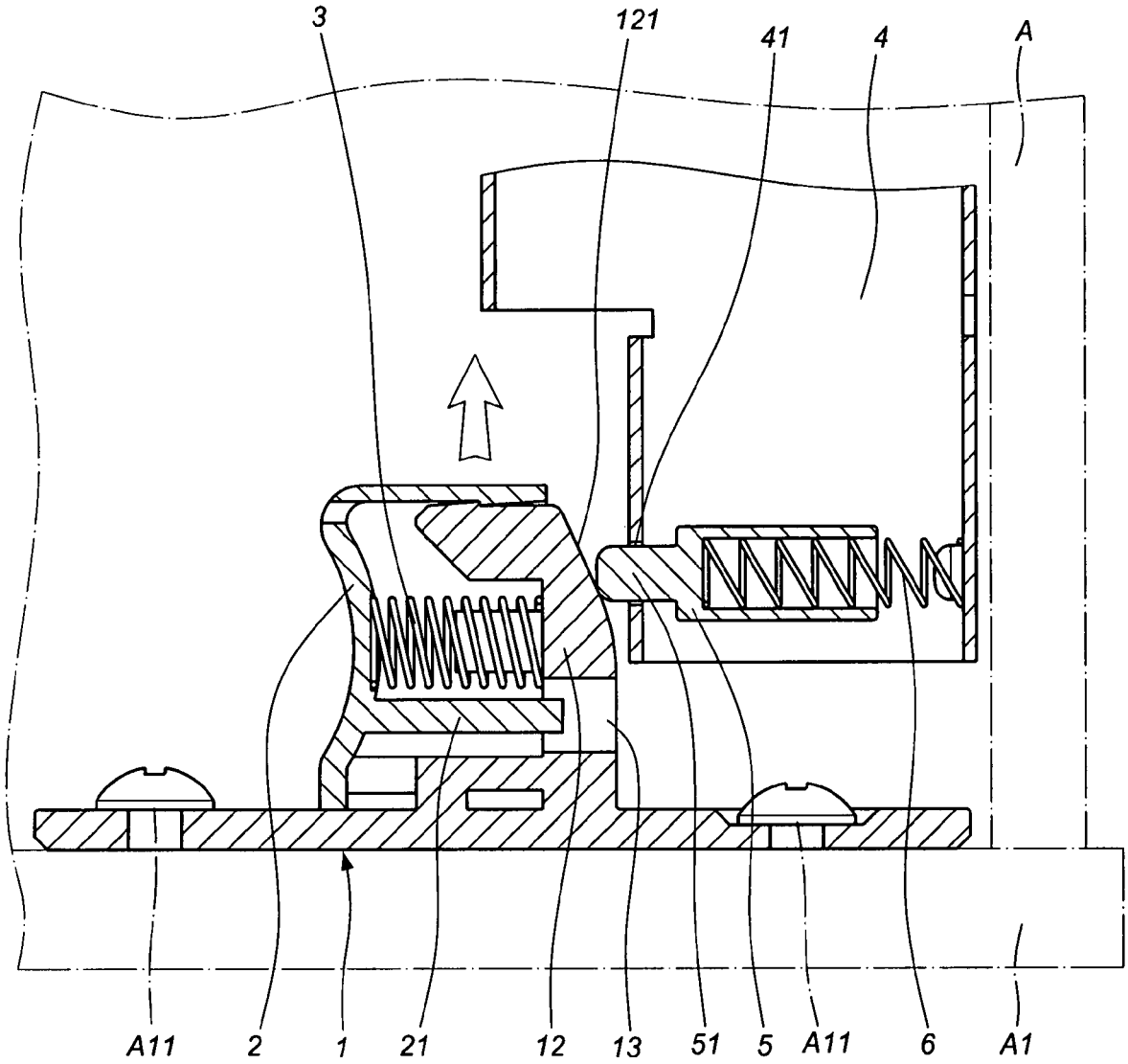
FIG. 5 is a cross-sectional view of the first embodiment of the present invention showing a pre-connection between a connecting element of the base and the holding element.

To operate the present invention, as shown in FIGS. 4 and 5, the base 1 is secured to the inner side of a panel A1 of a drawer A by means of fasteners A11 inserting through the fixing plate 11. The pressing element 2 and the first elastic element 3 are connected to the base 1. The holding element 5 is disposed in one end of the slide 4 and urged by the second elastic element 6.

To assemble the drawer A and the slide 4 of the present invention, as sown in FIG. 5, the drawer A is sliding along the slide 4. The slanting surface 121 of the connecting element 12 will push the engaging end 51 of the holding element 5 to move inwardly, and the holding element 5 compresses the second elastic element 6.

Figure 6:
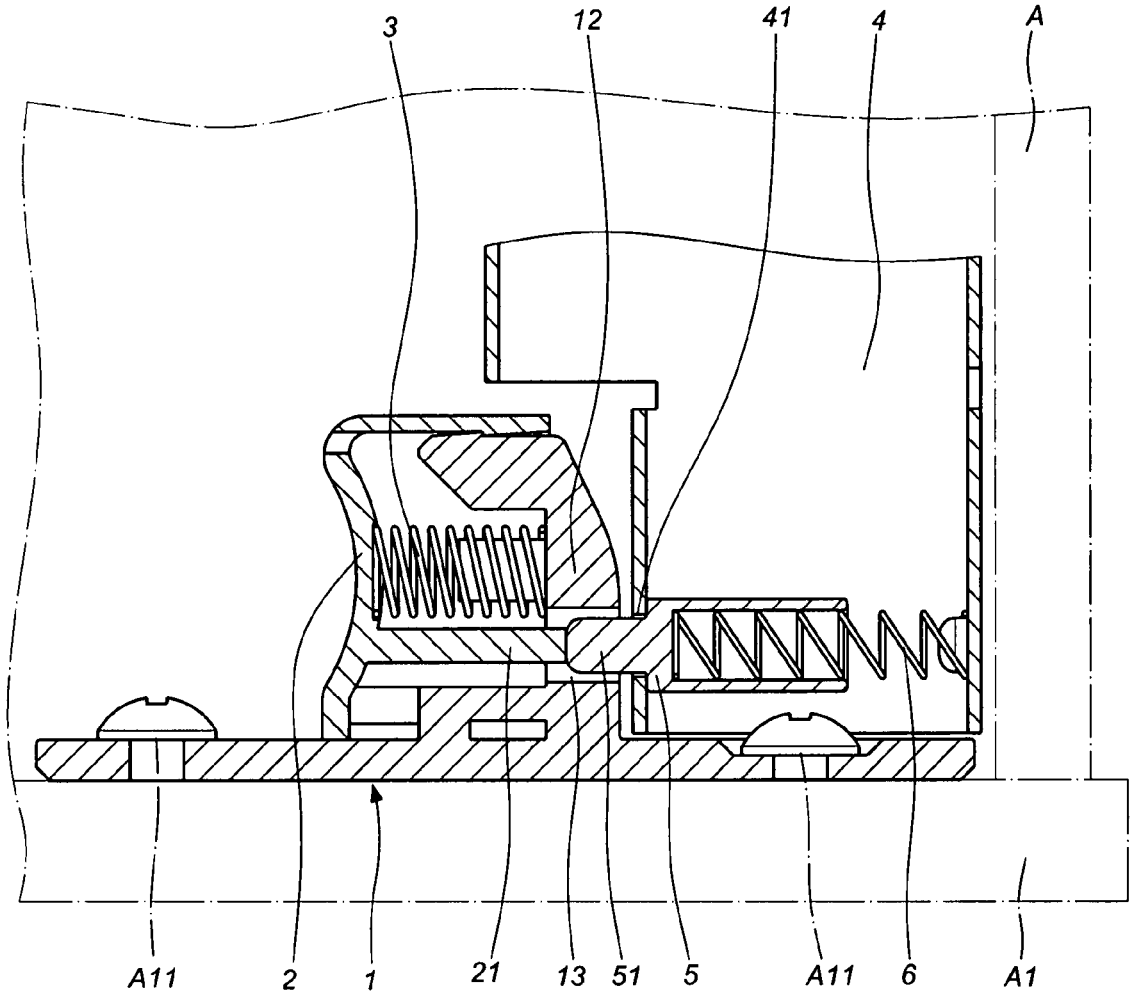
FIG. 6 is a cross-sectional view of the first embodiment of the present invention showing a connection between the connecting element of the base and the holding element.

When the through hole 13 of the connecting element 12 reaches to the engaging end 51, the second elastic element 6 will push the engaging end 51 of the holding element 5 into the through hoe 13, as shown in FIG. 6. The front end of the drawer A is secured to the slide 4. The connecting means of the rear end of the drawer A and the slide 4 is not the field of the present invention and will not be described hereinafter.

Figure 7:
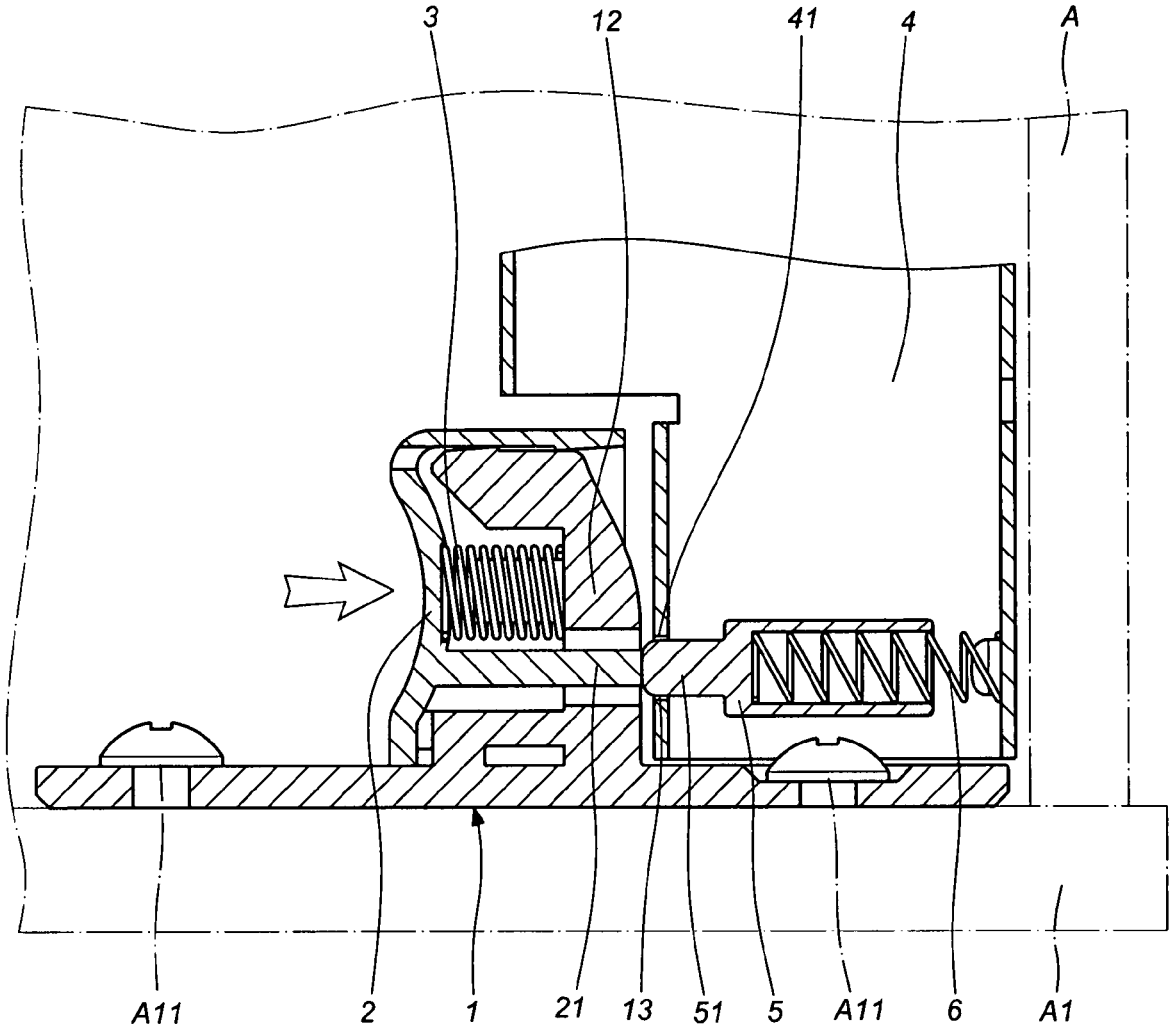
FIG. 7 is a cross-sectional view of the first embodiment of the present invention showing a releasing block of the pressing element pushing an engaging end of the holding element.

To release the securing status of the drawer A, as shown in FIG. 7, press the pressing element 2, the releasing block 21 will urge the engaging end 51 of the holding element 5 to retreat from the through hole 13 of the connecting element 12, thus the drawer A is released from the slide 4.

Figure 8:
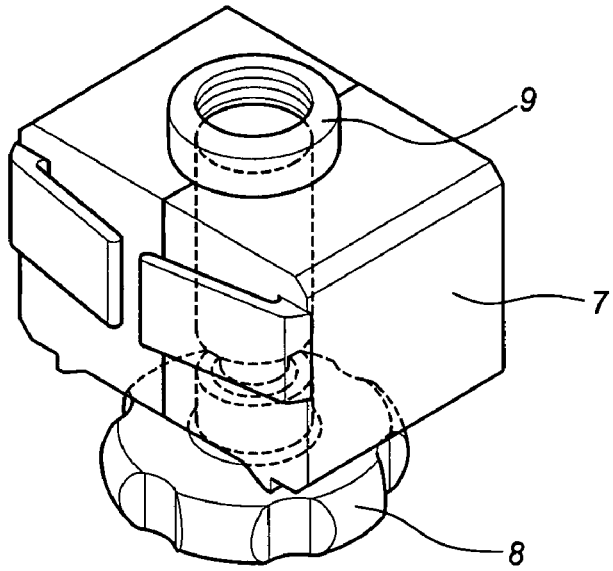
FIG. 8 is perspective view of a micro adjustment device of a second embodiment of the present invention.
Figure 9:
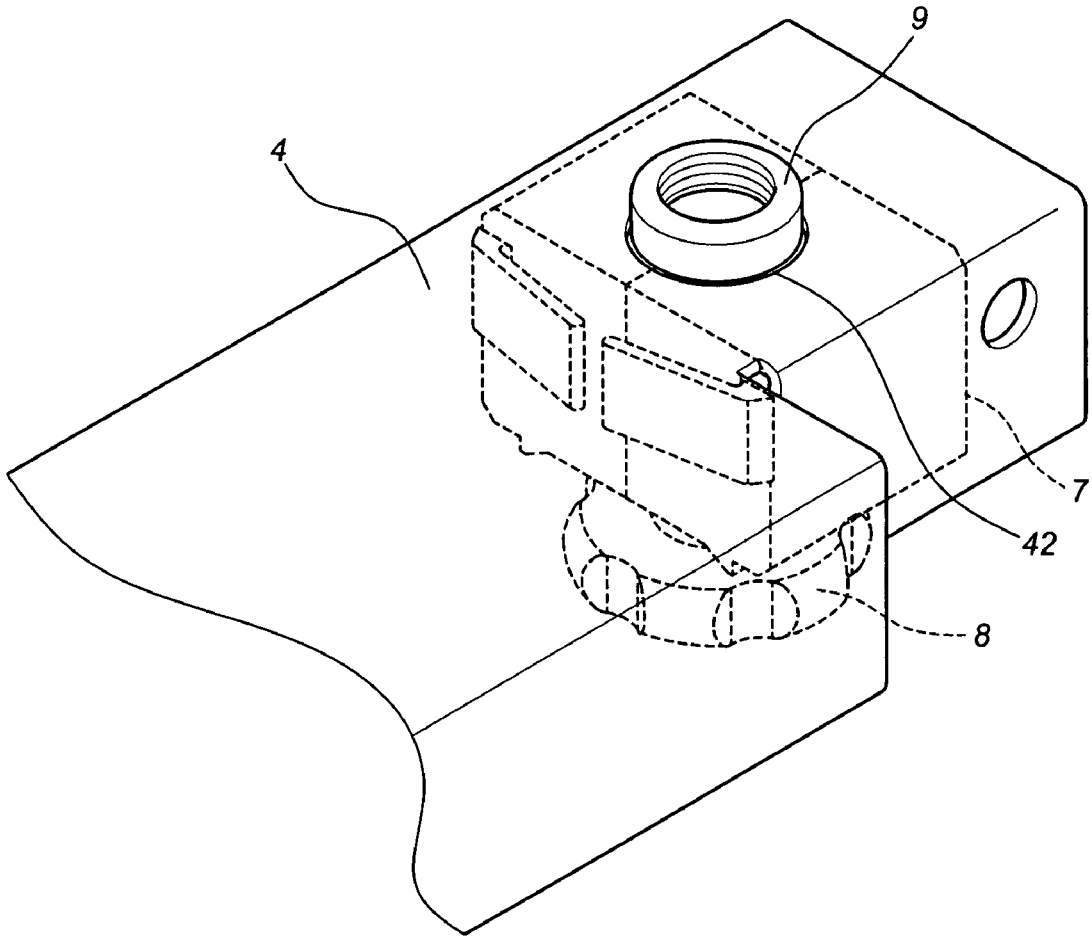
FIG. 9 is a perspective view of the micro adjustment device and the slide of the second embodiment of the present invention.

As shown in FIGS. 8 and 9, a second embodiment of the present invention relates to a micro adjustment device, so that the drawer A may be adjusted its height. The vertical through hole 42 of the slide 4 is provided with a sleeve 7. The sleeve 7 is connected with a knob 8 which then links a protruding sleeve 9 to move in relation to the vertical through hole 42 of the slide 4.

Figure 10:
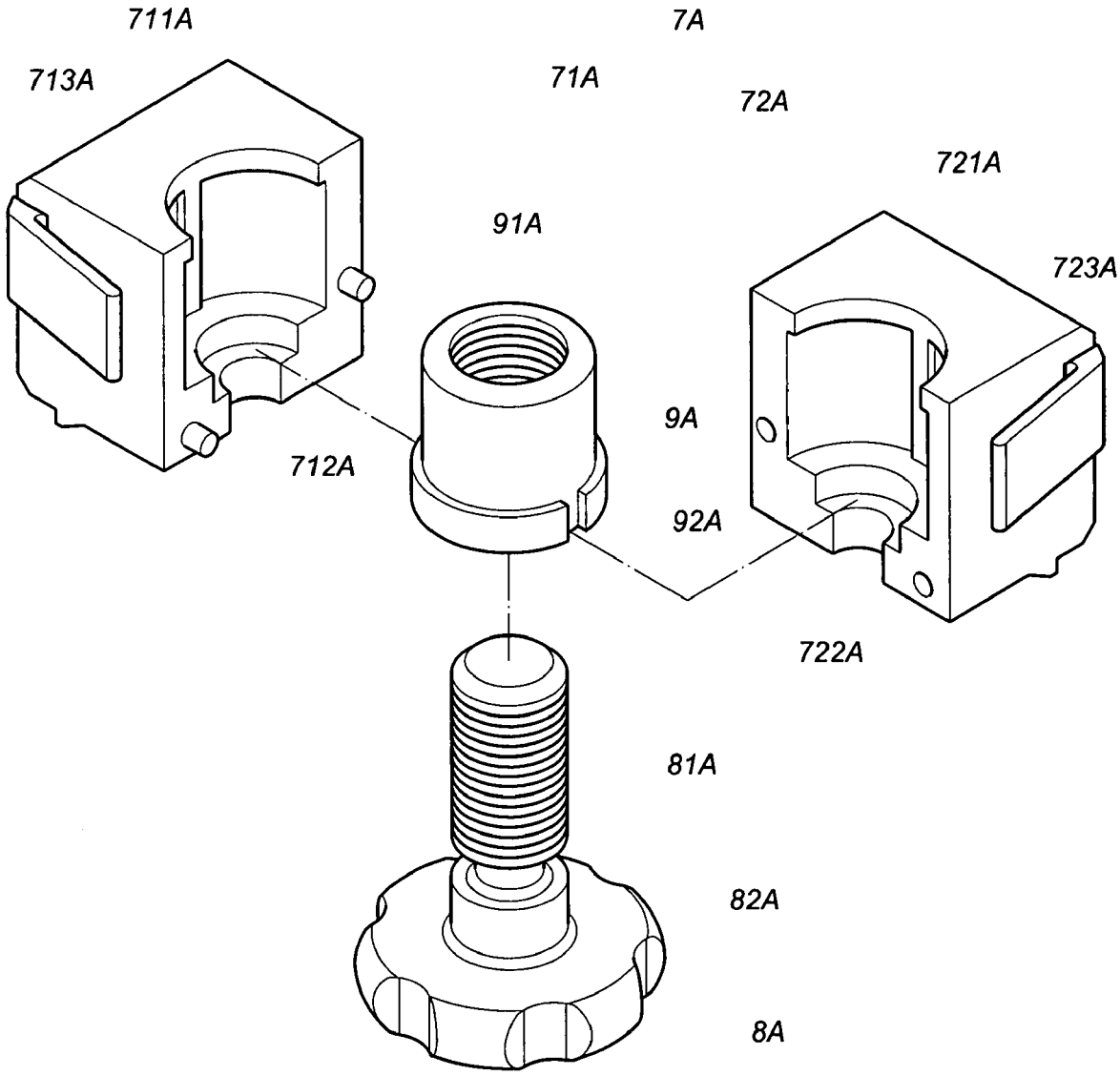
FIG. 10 is an exploded view of the micro adjustment device of the second embodiment of the present invention.

As shown in FIG. 10, a sleeve 7A is composed of a first case 71A and a second case 72A. The first case 71A has a first recess 711A and a first neck section 712A. The second case 72A has a second recess 721A and a second neck section 722A. The first recess 711A and the second recess 721A are to accommodate a protruding sleeve 9A which has inner threads 91A. A knob 8A comprises a threaded rod 81A which is connected with the inner threads 91A of the protruding sleeve 9A. Notches 92A are disposed on the protruding sleeve 9A. A protruding rib 713A is provided in the first recess 711A, and another protruding rib 723A is provided in the second recess 721A. The knob 8A has a circular groove 82A for engagement of the first neck section 712A and the second neck section 722A.

Figure 11:
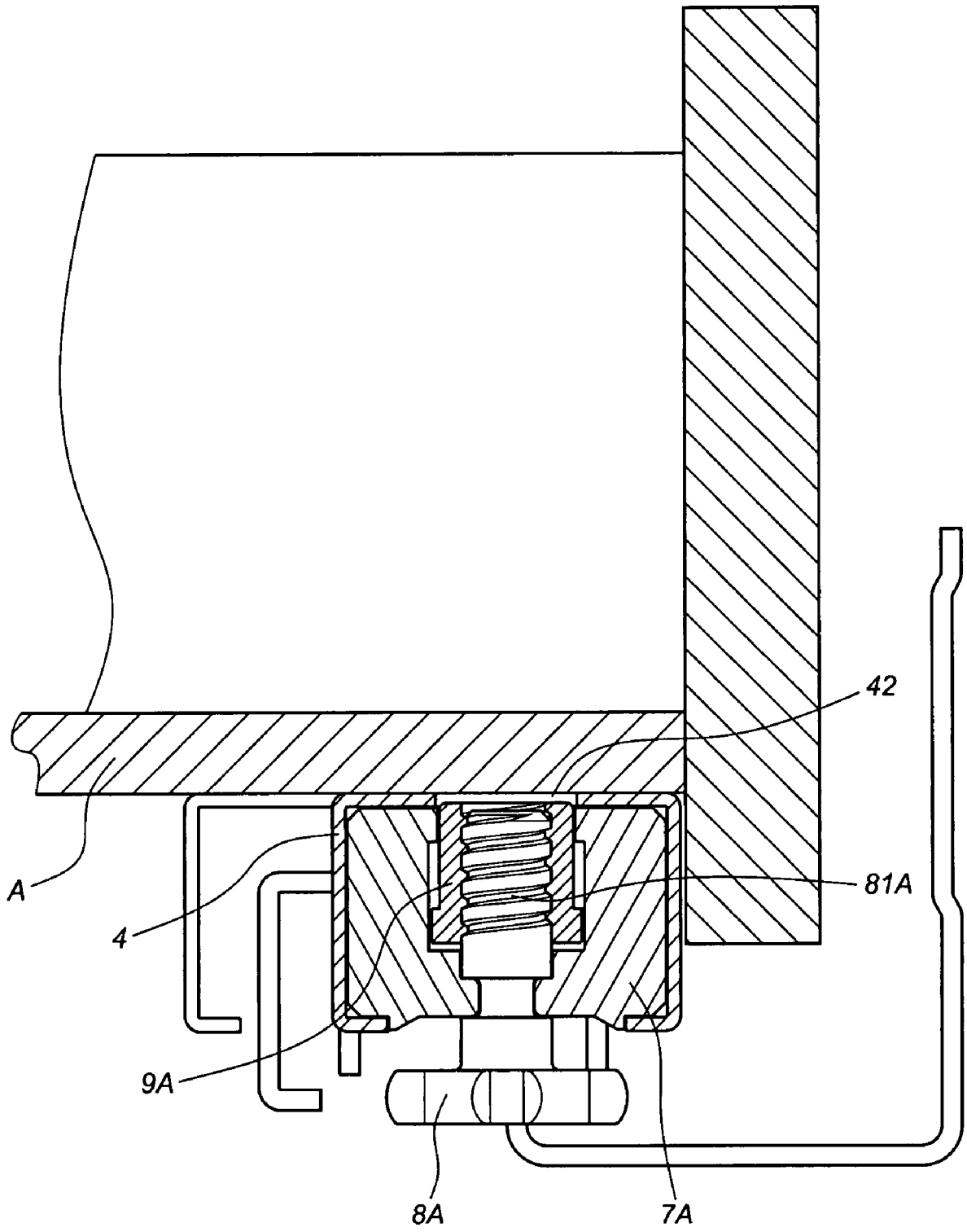
FIG. 11 is a side cross-sectional view of the micro adjustment device of the second embodiment of the present invention applied to a drawer (in an original position)
Figure 12:
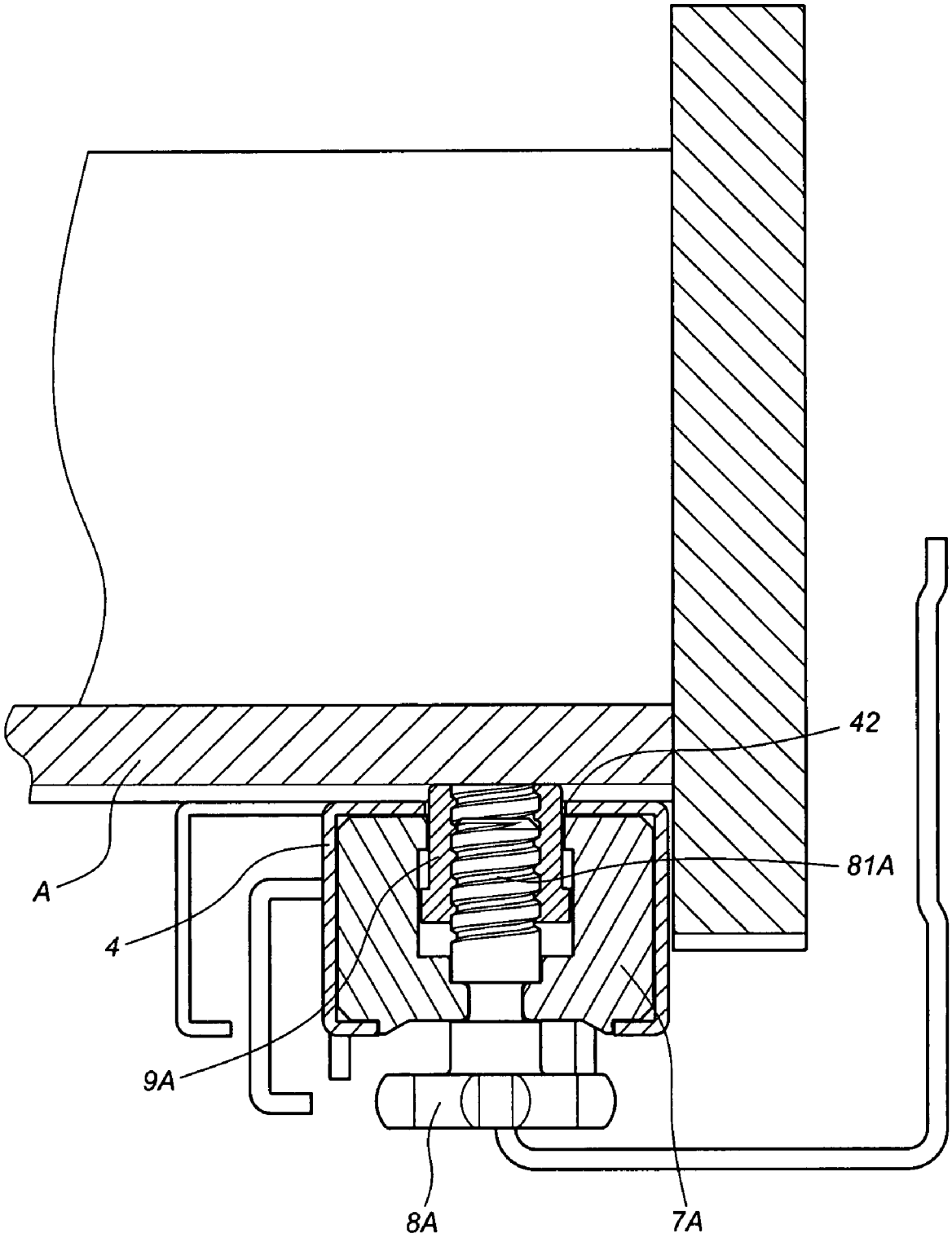
FIG. 12 is a side cross-sectional view of the micro adjustment device of the second embodiment of the present invention applied to a drawer (in a higher position than the original position)

As shown in FIGS. 11 and 12, when the protruding sleeve 9A is in a retreated position from the vertical through hole 42 of the slide 4, the bottom of the drawer A engages with the slide 4. By rotating the knob 8A, as shown in FIG. 12, the threaded rod 81A raises the protruding sleeve 9A upwardly and pushes the drawer A upwardly to adjust the height to an appropriate position.

Figure 13:
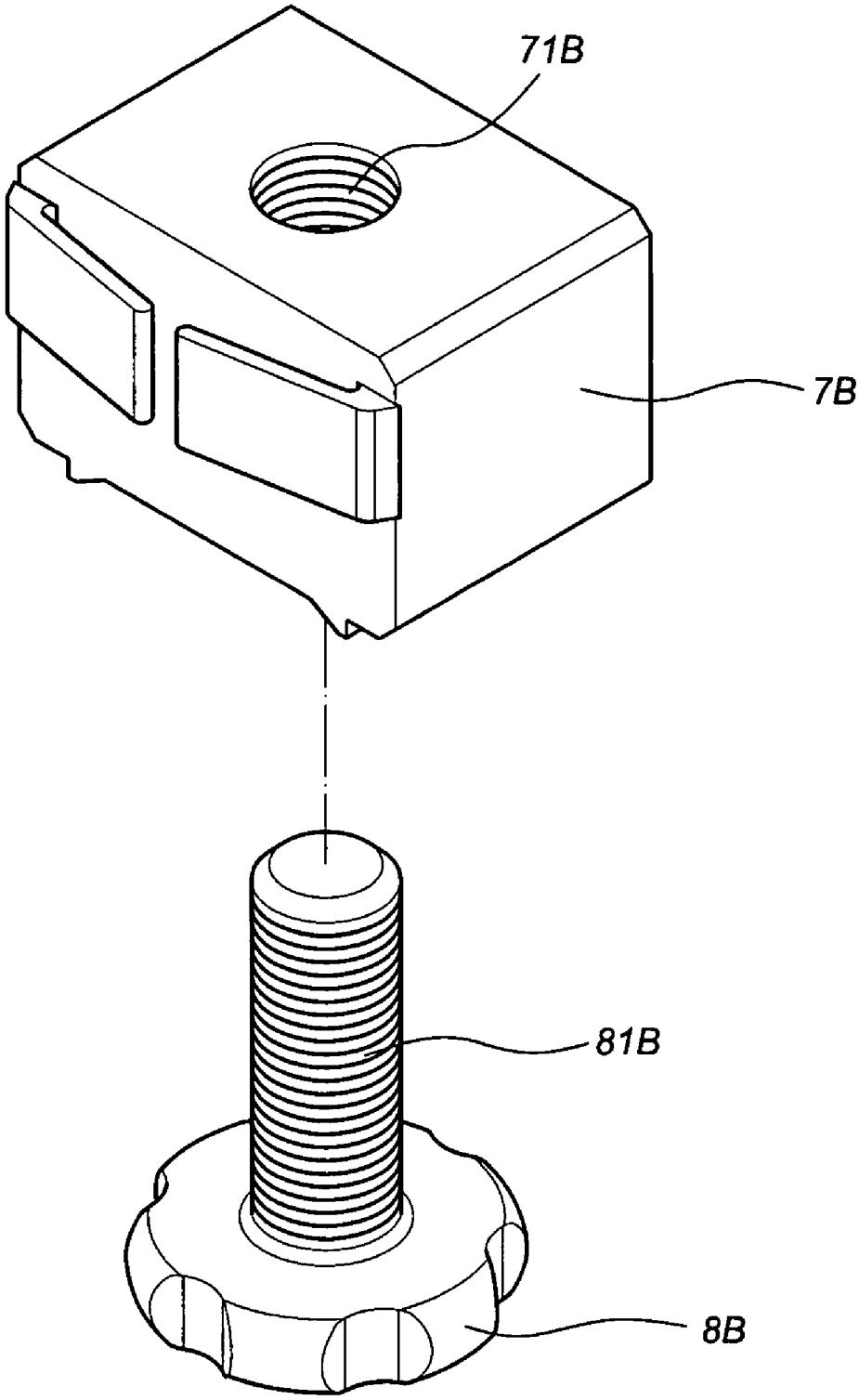
FIG. 13 is a perspective view of the micro adjustment device of a third embodiment of the present invention.

As shown in FIG. 13, a third embodiment of the present invention comprises a sleeve 7B and a knob 8B. The sleeve 7B is formed in an integral one, without the protruding sleeve 9/9A. The sleeve 7B has a threaded hole 71B. The knob 8B has a threaded rod 81B which is inserted into the threaded hole 71B of the sleeve 7B.

Figure 14:
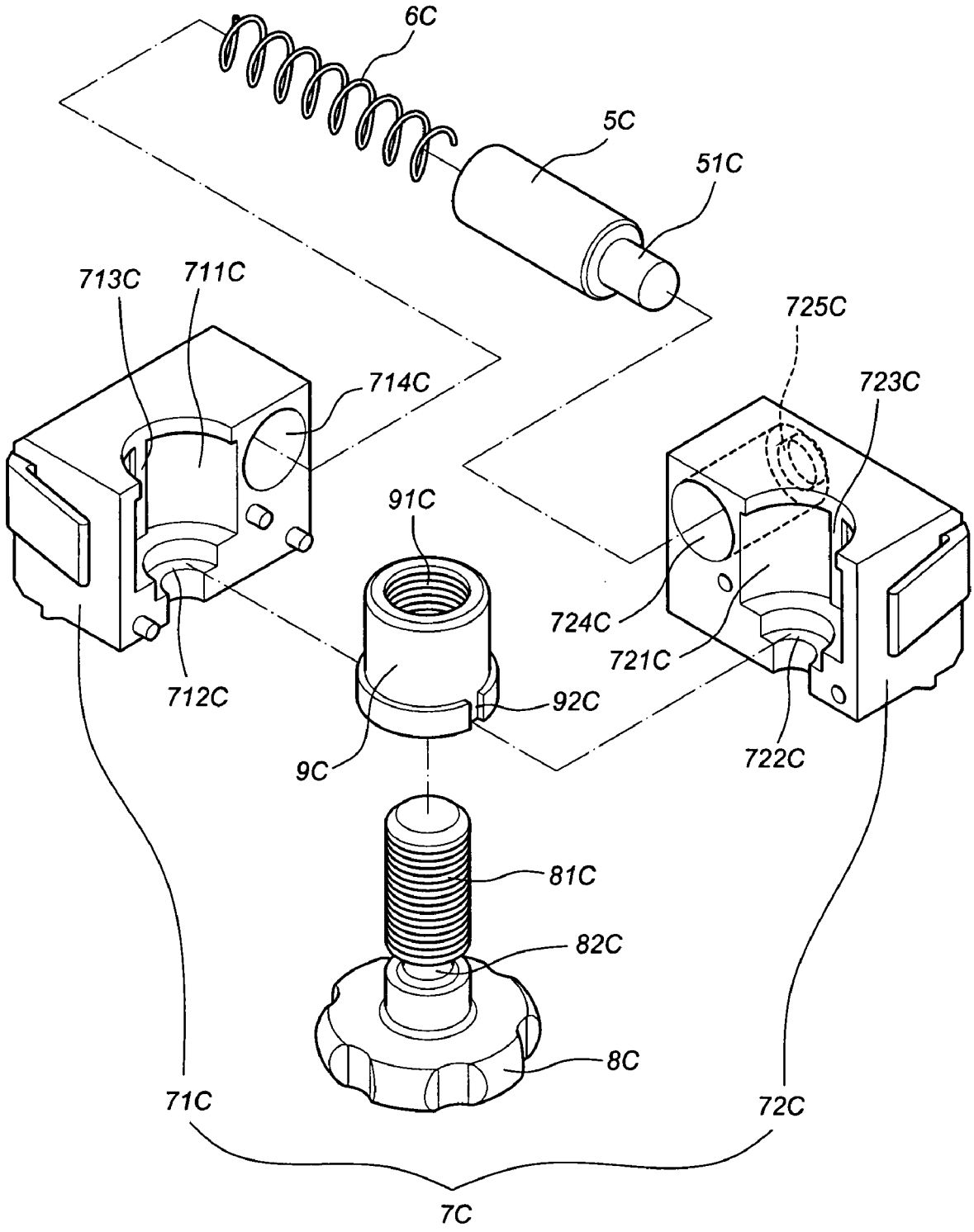
FIG. 14 is an exploded view of a fourth embodiment of the present invention showing the micro adjustment device incorporated with the holding element and the second elastic element.

As shown in FIG. 14, a fourth embodiment of the present invention combines a fixing device and a micro adjustment device together. The fixing device comprises a holding element 5C and a second elastic element 6C. The holding element 5C is connected to the second elastic element 6C. The holding element 5C has an engaging end 51C.

The micro adjustment device comprises a sleeve 7C, a knob 8C and a protruding sleeve 9C. The sleeve 7C is composed of a first case 71C and a second case 72C. The first case 71C has a first recess 711C and a first neck section 712C. The second case 72C has a second recess 721C and a second neck section 722C. The first recess 711C and the second recess 721C are to accommodate the protruding sleeve 9C which has inner threads 91C. The knob 8C comprises a threaded rod 81C which is connected with the inner threads 91C of the protruding sleeve 9C. Notches 92C are disposed on the protruding sleeve 9C. A protruding rib 713C is provided in the first recess 711C, and another protruding rib 723C is provided in the second recess 721C. The knob 8C has a circular groove 82C for engagement of the first neck section 712C and the second neck section 722C. The first case 71C has a hole 714C. The second case 72C has a second hole 724C and a through hole 725C. The second elastic element 6C and the holding element 5C are accommodated in the holes 714C and 724C, and the engaging end 51C of the holding element 5C extends outwardly from the through hole 725C.

Figure 15:
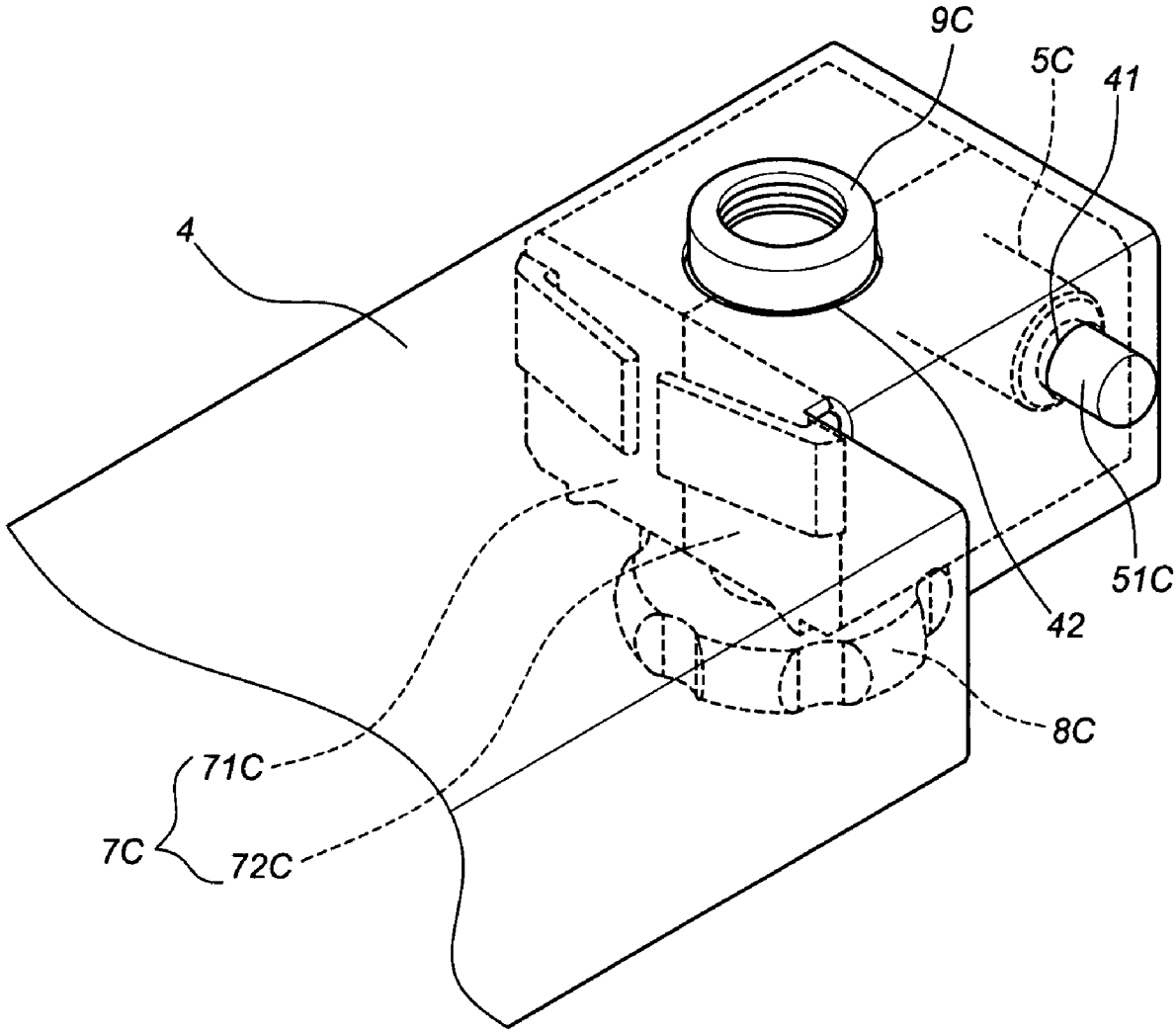
FIG. 15 is a perspective view of the fourth embodiment of the present invention showing that the micro adjustment device is connected with the holding element and mounted to the slide.

To install the fixing device and the micro adjustment device to the slide 4, as shown in FIG. 15, the sleeve 7C is disposed in one end of the slide 4. The knob 8C is connected to the sleeve 7C. The protruding sleeve 9C is disposed in the sleeve 7C and controlled by the knob 8 to move in relation to the vertical through hole 42 of the slide 4. The holding element 5A is disposed in the sleeve 7C. The engaging end 51A of the holding element 5A extends from the horizontal through hole 41 of the slide 4.

What is claimed is:

1. A securing device for a drawer slide, comprising:

a base comprising a fixing plate connected with a connecting element, said connecting element having a through hole;

a pressing element slidably connected to said connecting element of said base, said pressing element comprising a releasing block corresponding in position to said through hole of said connecting element;

a first elastic element accommodated between said connecting element and said pressing element; and a slide having a horizontal through hole and a holding element at one end thereof, said holding element having an engaging end and a connecting end, said engaging end being inserted through said horizontal through hole and extending outwardly from said slide, said connecting end being disposed in said slide and connected with a second elastic element;

wherein said slide comprises a sleeve at the end of said slide, said sleeve being connected with a knob and a protruding sleeve, said slide having a vertical through hole, said protruding sleeve being inserted through said vertical through hole and controlled by said knob; and wherein said sleeve comprises a first case and a second case, said protruding sleeve has inner threads, and said knob comprises a threaded rod and a circular groove, said first case comprising a first recess and a first neck section, said second case comprising a second recess and a second neck section, said first recess and said second recess accommodating said protruding sleeve, said threaded rod of said knob being connected to said inner threads of said protruding sleeve, notches being provided on said protruding sleeve, protruding ribs being provided in said first and second recesses in relation to said notches of said protruding sleeve, said circular groove of said knob engaging with said first neck section and said second neck section.

* * * * *